US008169313B2

(12) United States Patent
Cahn

(10) Patent No.: US 8,169,313 B2
(45) **Date of Patent: *May 1, 2012**

(54) METHOD AND APPARATUS FOR ASSET MANAGEMENT IN AN OPEN ENVIRONMENT

(75) Inventor: Robert S. Cahn, Carmel, NY (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 1000 days.

This patent is subject to a terminal disclaimer.

(21) Appl. No.: 12/132,539

(22) Filed: Jun. 3, 2008

(65) Prior Publication Data

US 2012/0081227 A1 Apr. 5, 2012

Related U.S. Application Data

(63) Continuation of application No. 11/233,426, filed on Sep. 22, 2005, now Pat. No. 7,388,481.

(60) Provisional application No. 60/611,982, filed on Sep. 22, 2004.

(51) Int. Cl.
*G08B 26/00* (2006.01)

(52) U.S. Cl. ..... 340/505; 340/572.1; 340/540

(58) Field of Classification Search ..... 340/505, 340/572.1, 540, 551

See application file for complete search history.

(56) References Cited

U.S. PATENT DOCUMENTS

| | | | |
|---|---|---|---|
| 5,886,634 | A | 3/1999 | Muhme |
| 6,232,877 | B1 | 5/2001 | Ashwin |
| 6,300,872 | B1 | 10/2001 | Mathias et al. |
| 6,609,656 | B1 | 8/2003 | Elledge |
| 6,987,948 | B2 | 1/2006 | Engstrom et al. |
| 7,123,149 | B2 | 10/2006 | Nowak et al. |
| 7,388,481 | B1 | 6/2008 | Cahn |

*Primary Examiner* — John A Tweel, Jr.

(57) ABSTRACT

A method and apparatus for asset management in an open environment are disclosed. In one embodiment, the method correlates a person's RFID tag with an RFID of an asset and uses this information to determine whether an asset is allowed to pass an access point.

20 Claims, 4 Drawing Sheets

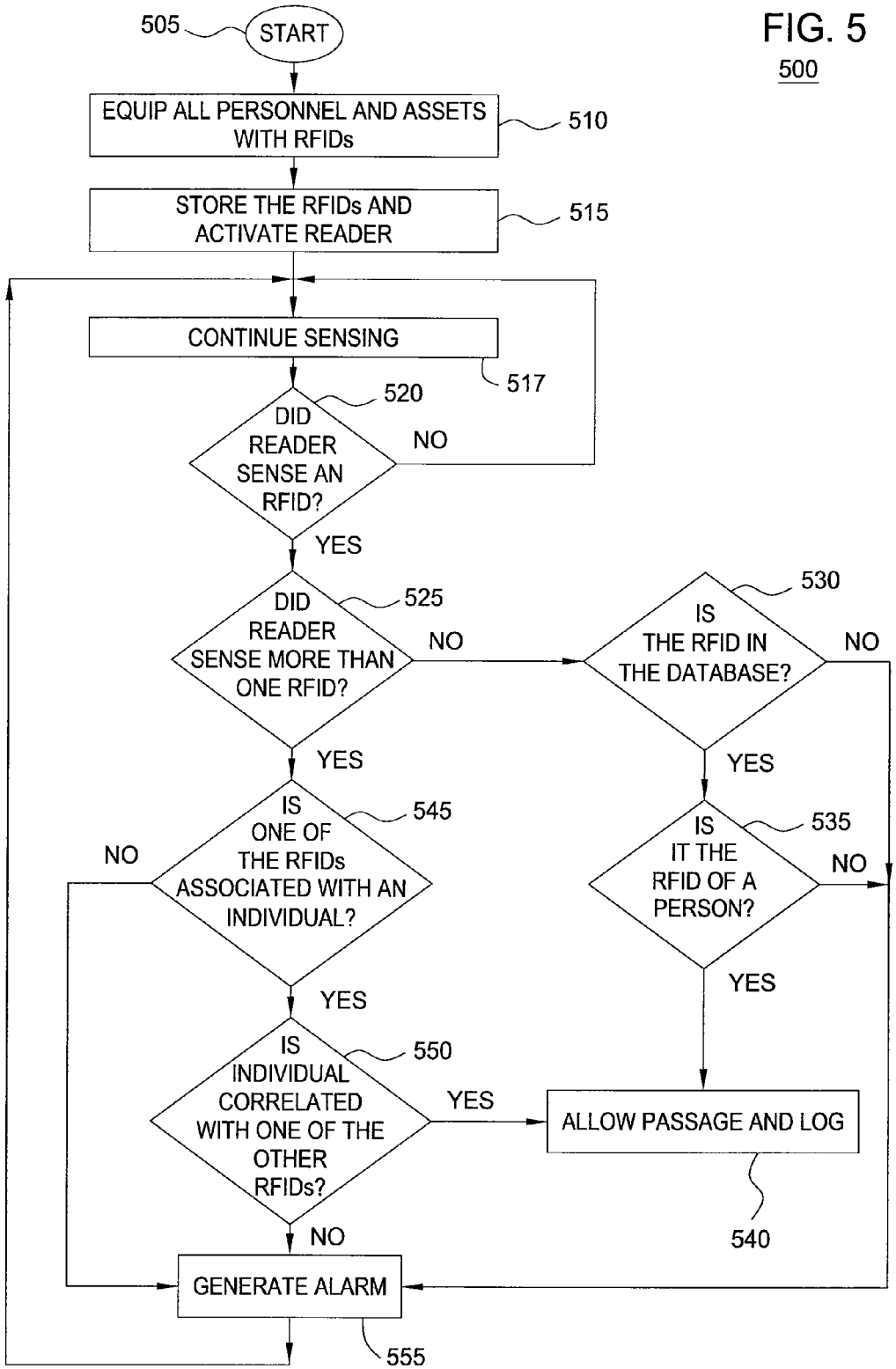
FIG. 5
500
505
START
EQUIP ALL PERSONNEL AND ASSETS WITH RFIDs
510
STORE THE RFIDs AND ACTIVATE READER
515
CONTINUE SENSING
517
DID READER SENSE AN RFID?
520
NO
YES
DID READER SENSE MORE THAN ONE RFID?
525
NO
YES
IS THE RFID IN THE DATABASE?
530
NO
YES
IS ONE OF THE RFIDs ASSOCIATED WITH AN INDIVIDUAL?
545
NO
YES
IS IT THE RFID OF A PERSON?
535
NO
YES
IS INDIVIDUAL CORRELATED WITH ONE OF THE OTHER RFIDs?
550
YES
NO
ALLOW PASSAGE AND LOG
540
GENERATE ALARM
555

METHOD AND APPARATUS FOR ASSET MANAGEMENT IN AN OPEN ENVIRONMENT

This application is a continuation of U.S. patent application Ser. No. 11/233,426, filed Sep. 22, 2005, entitled, "METHOD AND APPARATUS FOR ASSET MANAGEMENT IN AN OPEN ENVIRONMENT", now patented as U.S. Pat. No. 7,388,481 which claims the benefit of U.S. Provisional Application No. 60/611,982 filed on Sep. 22, 2004. All of the above-cited applications are herein incorporated by reference in their entirety.

The present invention relates generally to asset management and more particularly to Radio Frequency Identification (RFID) tagging for asset management in an open environment.

BACKGROUND OF THE INVENTION

The protection of personal computers and other valuable company assets was easy when the hardware assets were large and cumbersome. Consequently nobody had to worry about assets being stolen.

In today's global economy, companies hire both employees and contractors to complete work assignments. Employees and contractors share the same office space and work in an open environment. Many employees and contractors work in cubicles and therefore do not have doors with locks to protect their assets. Hardware assets such as cell phones, personal computers and the like have shrunk in size and are easily portable. While some attempts have been made to secure personal computers by cable locks, these are not effective at controlling theft as the cables can be cut. Furthermore, when hardware assets are lost, companies lose more than just the assets. Companies lose valuable data that may be stored in the asset and the time taken to replace the assets.

Therefore, a need exists for asset management in an open environment.

SUMMARY OF THE INVENTION

In one embodiment, the present invention discloses a method for managing assets in an open environment. Large businesses and organizations have assets to protect and have a need to provide some measure of security for these assets. In one embodiment, the present invention correlates an asset's RFID tag with an owner's RFID tag at an access point. If the asset's RFID tag is detected at the access point without the corresponding detection of the owner's RFID tag, then an alarm is triggered. Thus, the present invention will assist security personnel in reducing security breaches associated with thefts of company assets.

BRIEF DESCRIPTION OF THE DRAWINGS

The teaching of the present invention can be readily understood by considering the following detailed description in conjunction with the accompanying drawings, in which:

FIG. 5 illustrates a flowchart of a method for asset management in an open environment.

To facilitate understanding, identical reference numerals have been used, where possible, to designate identical elements that are common to the figures.

DETAILED DESCRIPTION

The present invention broadly discloses a method for asset management in an open environment. Although the present invention is discussed below in the context of asset management in an office building or buildings, the present invention is not so limited. Namely, the present invention can be applied in the context of improving security in libraries, video rental stores, rental car companies and the like.

In order to clearly illustrate the current invention, the following concepts will first be described:

Radio Frequency Identification (RFID);

Manned Entry (ME); and

Controlled Entry point (CE).

Radio Frequency Identification (RFID) is a method of storing and remotely retrieving data using RFID tags or transponders. With RFID the electromagnetic coupling in the RF portion of the RF spectrum is used to transmit signals. An RFID tag is a small object that can be attached to or incorporated into a product, animal or person. RFID tags contain antennas to enable them to receive and respond to radio frequency queries from an RFID transceiver.

Manned Entry (ME) refers to a location (e.g., an access point) in a building or a site at which security guards can check people or assets entering or leaving the building. A Manned Entry location or access point may also have RFID sensors.

Controlled Entry (CE) point refers to an entry or exit location (e.g., an access point) in a building where there are no security guards. All checking of people and assets can be performed electronically at Controlled Entry points.

Figure 1:
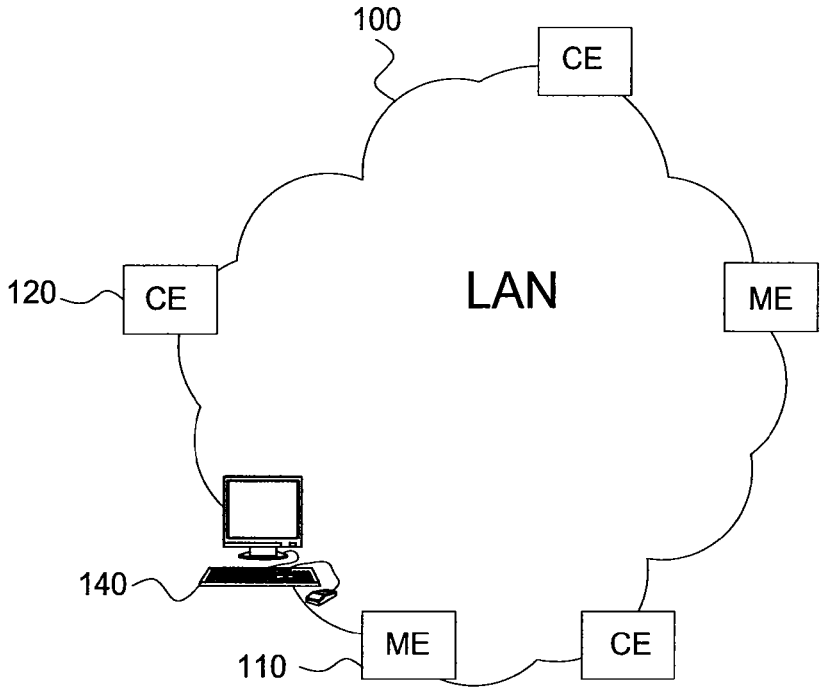
FIG. 1 illustrates an exemplary Local Area Network related to the present invention.

To better understand the present invention, FIG. 1 illustrates an example network, e.g., a Local Area Network (LAN) 100 related to the present invention. The LAN may span various office buildings or it may be used to interconnect several entry and exit locations within an office building.

In most large companies today employees get a paper title certificate for an asset when it is to be removed from an office building. The employee exits at an access point, e.g., ME 110, where a security guard will ask employees to open their bag to examine the title certificate, and then makes a determination about whether the employee can leave the building with the asset. This process is time consuming and costly because it requires a ME at each exit point to ensure that company assets are not improperly removed.

The method of the present invention for asset management in an open environment replaces the slow manual process with an electronic approach. In this method, access points may comprise MEs and/or CEs. CE 120 is an example of a location at which the entry point is controlled electronically.

In the environment utilizing the current invention, each employee working in an office building or complex has an RFID badge. Similarly each valuable asset is tagged with an RFID. All of the RFID information for each tagged asset and employee in the office building or complex is stored, e.g., in an application server 140. The RFID information collected from all CEs, e.g., via one or more RF sensors (e.g., RFID readers), can be forwarded electronically to the application server 140 that will analyze the RFID for authenticity. Each time someone and/or an asset crosses an access point of the office complex or an office building, the appropriate RFID information will be sensed at a CE or an electronically equipped ME.

Figure 2:
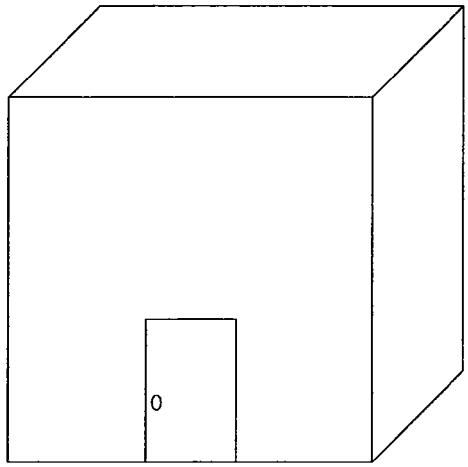
FIG. 2 illustrates controlled access to an open environment.

FIG. 2 illustrates an exemplary access point to an open environment. The figure shows a controlled entry or exit point (e.g., CE 100 as shown in FIG. 1). In one embodiment, this location is equipped with an RFID reader that senses the RFID information of each item and/or person entering or leaving the CE. Proper matching of asset with the corresponding owner will only trigger a logging operation where the application server will simply note that the owner with a particular asset has crossed a particular access point, whereas an asset not properly matched with its owner will trigger an alarm. It should be noted that although FIG. 2 illustrates an access point as a doorway, the present invention is not so limited. Namely, the access point can also be a window, a hall way, an entry way for vehicles, an elevator and the like.

Figure 3:
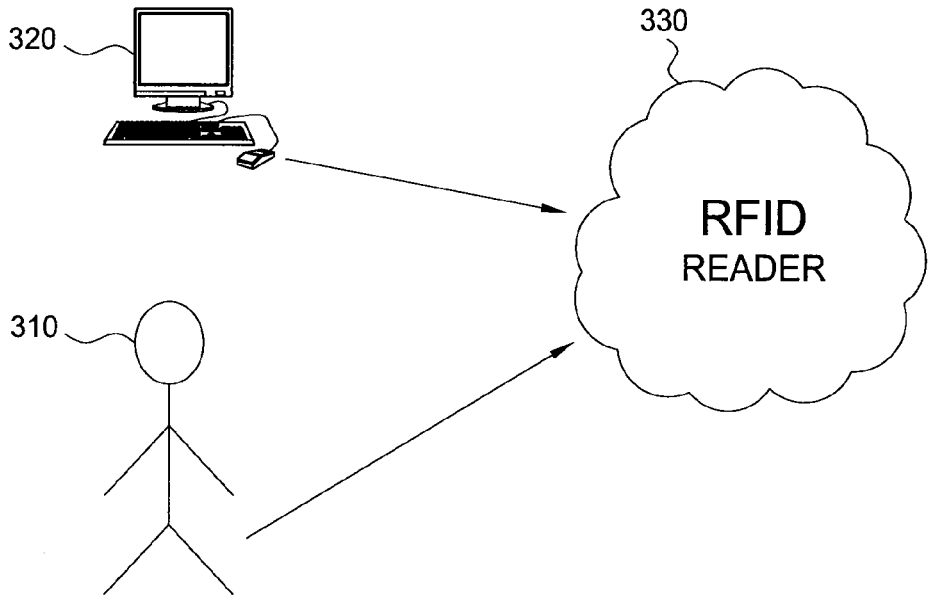
FIG. 3 illustrates an electronic title certificate.

FIG. 3 illustrates an electronic title certificate. When an employee 310 wishes to leave the premise with a company asset, e.g., a laptop computer 320, the employee will inform the appropriate personnel within the company. This information is then communicated to security personnel and/or to facility or asset management personnel. In one embodiment, the information associated with the asset to be removed from the premise and the employee authorized for the removal is entered into the server 140 of FIG. 1. For example, the RFID of the asset and the RFID of the employee will be correlated as a match. The employee can then simply exit the premise with the asset at any monitored exit and at any time, where the event will be detected and logged without the involvement of security personnel. Namely, a correlation is made between the RFID of the person and the asset. This correlation can be done locally at the RFID reader or remotely at server 140.

To illustrate, the laptop 320 of FIG. 3 may contain one or several RFID tags embedded into the case, motherboard, keyboard or display. Ideally, the RFID tags should be attached in such a way that they are difficult to remove or shield. Similarly, the employee RFID should ideally be small and capable of being attached to a key ring or a badge that can be placed in a purse or wallet.

Upon exiting, the RFID of employee 310 and the RFID of the laptop 320 are read by a RFID reader 330. The RFID of the employee effectively serves as the Title Certificate for the laptop. Server 140 of FIG. 1 processes the RFID information sensed by RFID reader 330 to determine whether a match has been detected. Without correlation between the RFID of the employee and RFID of the asset, the controlled exit of FIG. 2 will not open and the person carrying the asset will not be allowed to leave.

Although the present invention is an effective and novel method in providing asset management in an open environment, there is a possibility that the system may be the subject of an attack. For example, an individual may deploy one or more rogue RFID readers to read RFIDs of employees or owners of the assets at a location that is near an access point. This information can be used to produce "forged" titles, thereby enabling people to leave controlled entry points with valuable assets. In one embodiment, forged title certificates can be prevented by applying encryption to the RFID information, e.g., Identify Friend or Foe (IFF) challenge response technology.

Figure 4:
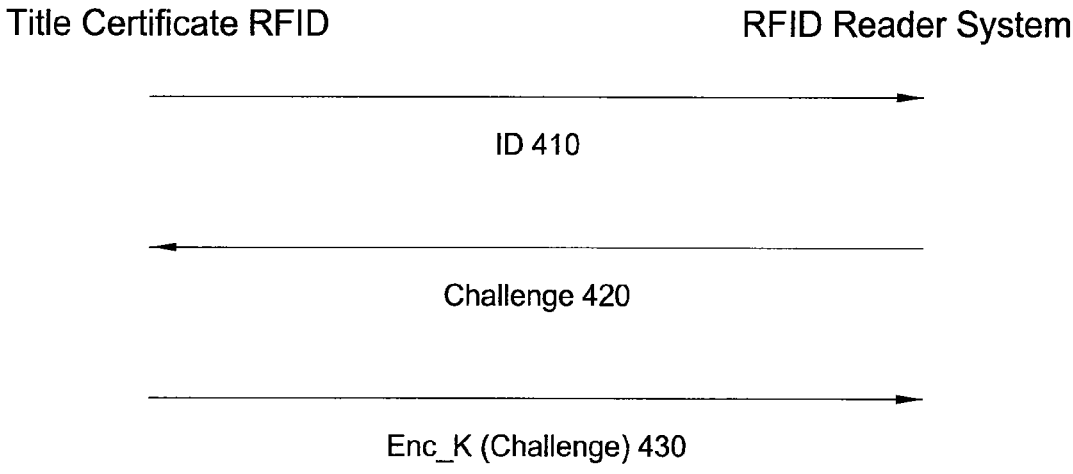
FIG. 4 illustrates Identify Friend or Foe title certificate and RFID reader system flows.

In one embodiment of asset management in an open environment, IFF challenge response technology is used to significantly reduce if not eliminate the instances of forged title certificates. FIG. 4 illustrates IFF title certificate and RFID reader system flows. In one embodiment, the RFID chip installed on the asset and/or the RFID of the employee has an embedded crypto key K. Crypto key K is known either locally at the RFID reader or at an application server 140 that resides on the LAN described in FIG. 1. For example, the RFID chip in the asset is capable of encoding a random string of data that it receives from an RFID reader. The same encoding capability is also present at the RFID reader or the application server to which the RFID information received from the RFID reader is sent.

To illustrate, the RFID chip on the asset constantly transmits its RFID 410. When the asset is detected by an RFID reader, the reader receives the ID 410 and transmits a challenge response 420 that is comprised of a random string of data. The RFID reader or the application server is able to compute the encryption key applied to the challenge response 420. When the RFID chip on the asset receives the challenge string from the RFID reader, it computes the encryption key applied to the challenge response 420 which is message 430 and it then transmits an encryption challenge response 430. The RFID reader receives the encryption challenge key 430 generated by the Title Certificate RFID chip and sends the information to the application server. If the encrypted string generated by the Title Certificate RFID chip matches the encrypted string stored locally at the RFID reader or remotely on the server, then the RFID is a true Title Certificate. This exemplary IFF flow can also be applied to the RFID of the employee or owner.

A second possible method of attack of the RFID based security system is trapping the Electromagnetic (EM) radiation. It is well known that a Faraday cage traps EM radiation. Thus, if someone places a laptop or other asset in a metal box, the RFID tags will be unable to transmit any information to the RFID reader. Namely, the asset may become practically invisible to the RFID reader. However, if a magnetometer is optionally added to the security system, then someone being detected with carrying a certain amount of metal in any object that exceeds a threshold will be questioned and/or denied from exiting the access point. For example, the person will be directed to go through a ME at which point all items can be searched by a security guard. This optional implementation will keep the RFID tags from being masked from the RFID reader.

Another feature of the method of asset management in an open environment is illustrated in the following example. If all of the important items carried by a person inside an office building have documented RFID tags, the RFID reader can be used as an alarm. For example, if the person tries to exit the building or complex and has not taken all of the items with RFIDs, the RFID reader can be used as an alarm to let the person know that they have forgotten some items. If the owner wishes, he or she can acknowledge the alarm and exit. Otherwise, the person can return to retrieve the missing items.

The present method of asset management in an open environment has other applications. When a book is checked out at a library, the ownership of the book is essentially associated with a person on a temporary basis. If each book in the library is given an RFID and the borrower's library card is an RFID enabled card, the RFID reader located at a door can ascertain whether or not a book that is being taken out of the library has been properly checked out, i.e., properly associated with a RFID enabled library card. Using the present invention, automated kiosks can be deployed in the library for self check out without the involvement of librarians. Improperly checked out books will generate an alarm at the access point.

Another application of the method of asset management in an open environment is its use in Video Rental stores. This is similar to the library example given above except that a video rental card is substituted for the library card and a tape or DVD for the book.

The method of asset management in an open environment is also applicable to rental car companies. When a customer leaves the lot there is always an employee deployed at the exit point to verify that the driver has a contract that matches the vehicle. Thus, RFIDs can be deployed on the vehicles and an RFID can be carried by the customer, e.g., an RFID given to the customer at the check-in counter of the rental company or the customer is carrying an RFID enabled driver license that has been read by an RFID reader at the check-in counter. In this application, the temporary assignment of ownership is given to the renter. If the license or the provided RFID tag and car match, then they are allowed to leave the lot without the involvement of an attendant.

FIG. 5 illustrates an exemplary method 500 for asset management in an open environment. Method 500 begins at step 505 and proceeds to step 510.

In step 510, security personnel in an office building or complex distribute RFID badges or key rings to everyone. Additionally, all valuable assets are equipped with RFIDs. In one embodiment, manufacturers of these assets would implant the RFIDs inside the assets in such as way that the RFIDs would be difficult to remove. Security personnel would then assign a unique RFID identifier to each of these assets or detect a unique RFID identifier assigned by the manufacturer of the asset.

Method 500 proceeds to step 515 where the RFIDs of each person and asset is stored on an application server. Proper correlations between owners and assets can be entered or removed as the need arises.

In large companies with several entry and exit locations, method 500 can be used to reduce the amount of security personnel employed to secure the entrances and exits to their facilities. Namely, some entry and exit locations can be unmanned with RFID technology being used as a critical element of their security. In this environment, the RFID readers can be interconnected to a central location where the data processing can be performed centrally. Once activated, the RFID readers will begin to sense for RFIDs. The RFID readers have an activity radius i.e., a radius within which they are able to accurately sense RFIDs at the access point. This range or volume of space at the access point where the RFIDs of the owner and assets are detected will depend on the requirements of a particular application. For example, the car rental application may require a larger radius compared to the library book application.

In step 517, the RFID reader is activated and is continuously sensing for RFIDs. If a person or asset is not within the appropriate radius or range, the readers will not sense an RFID and will continue sensing for RFIDs.

In step 520, the RFID reader determines whether or not it senses an RFID. If an RFID is not sensed, the method loops back to step 517 and continues sensing for an RFID. If the RFID reader senses an RFID, it proceeds to step 525.

In step 525, method 500 determines whether more than one RFID is sensed simultaneously. In one embodiment, the RFID sensor determines a number of sensed RFIDs that are detected simultaneously based upon a predefined threshold of time, e.g., a few seconds depending on the application. For example, if two RFIDs are sensed in a time that is less than the threshold, then the system will record two RFIDs as being sensed simultaneously. If the two RFIDs are sensed in a time that exceeds the time threshold, then the method assumes that the detection of the two RFIDs are not correlated. If the method determines that it has sensed more than one RFID, it will proceed to step 545 to determine whether one of the detected RFIDs is associated with an individual, e.g., an owner, an employee, a renter, a customer and so on. Otherwise, the method proceeds to step 530 to determine whether the RFID is in the database.

In step 530, the reader communicates with the application server to determine whether the RFID sensed in step 525 is in a database of RFIDs. If the sensed RFID is not in the database, the method proceeds to step 555 where an alarm is generated, e.g., alerting security personnel. In one embodiment, to reduce such false alarms, "visiting" RFIDs can be registered at the ME before being allowed onto the premise. The detected RFID may indicate that an unidentified individual is at the access point or an unidentified asset is at the access point. If the RFID is in the database, method 500 proceeds to step 535.

In step 535, the reader determines whether the RFID sensed in step 530 is that of an individual. If it is determined that it is in fact an individual, then method 500 proceeds to step 540 to allow passage through the access point, e.g., releasing a lock on a door, lifting a gate, and the like. However, if the RFID is that of an asset, then method 500 proceeds to step 555 to generate an alarm, e.g., alerting security personnel that an asset is being removed from the premise without being correlated to a proper individual. In turn, passage is denied. In one embodiment, whether passage is denied or not, the event is logged and stored as a retrievable record.

In step 545, the list of RFIDs sensed by the reader is evaluated against a database to determine whether one of the detected RFIDs is associated with an individual, e.g., an owner, an employee, a renter, a customer and so on. If none of the RFIDs matches an individual, then method 500 proceeds to step 555 to generate an alarm. The detected RFIDs may indicate that numerous assets are at the access point without any of them being correlated to at least one proper individual. If an individual's RFID was sensed in the list of RFIDs, method 500 continues to step 550.

In step 550, method 500 determines whether all of the other detected RFIDs are correlated with the detected RFID associated with the individual. In one embodiment, this can be accomplished by having the RFID reader communicate with the application server that stores all of the RFIDs. If the method is able to determine that there is a proper correlation between the detected individual and the detected asset(s) at the access point, then method 500 proceeds to step 540 to allow passage and to log the event. If the method cannot correlate the detected individual with the detected asset(s) at the access point, then the method proceeds to step 555 to generate an alarm.

In step 555, method 500 generates an alarm, e.g., alerting security personnel that a security violation may have occurred. The alarm signal can be an audible alarm, e.g., a buzzer, a horn, a bell and the like or a visible alarm, e.g., a flashing light, a flashing LED, a flashing symbol or icon on a screen monitored by security personnel and the like. At a CE the exit may be automatically locked. For example, a person approaches the exit with three RFID enabled assets but forgot their own RFID key ring. The sensor would detect three assets but would not be able to detect the matching RFID for the employee. When the security person arrives at the exit location, he or she would be able to inform the employee that he or she is not carrying the RFID key ring or badge and that it will be necessary to produce the proper RFID at the access point in order for the employee to remove the detected assets from the premise.

Method 500 may continue to sense RFIDs even when an alarm is generated and security is called. This allows other RFIDs to be processed while security personnel are investigating possible security breaches. The method proceeds to step 517 to continue sensing RFIDs.

Figure 6:
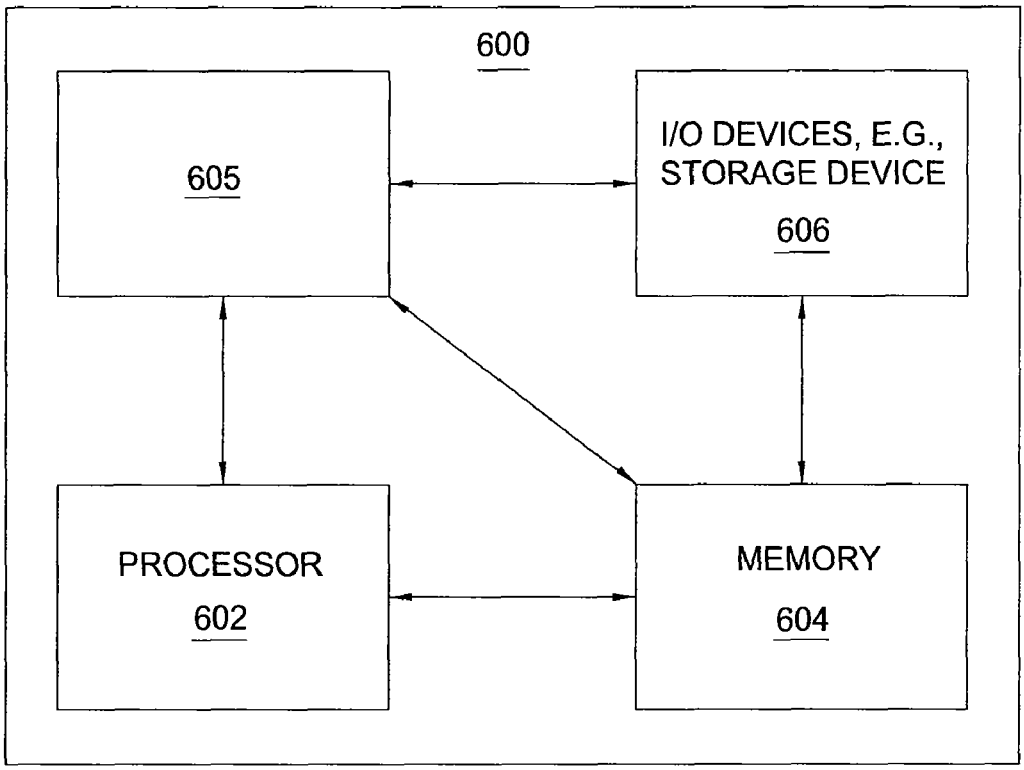
FIG. 6 illustrates a high-level block diagram of a general-purpose computer suitable for use in performing the functions described herein.

FIG. 6 depicts a high-level block diagram of a general-purpose computer suitable for use in performing the functions described herein. As depicted in FIG. 6, the system 600 comprises a processor element 602 (e.g., a CPU), a memory 604, e.g., random access memory (RAM) and/or read only memory (ROM), a module 605 for asset management in an open environment, and various input/output devices 606 (e.g., storage devices, including but not limited to, a tape drive, a floppy drive, a hard disk drive or a compact disk drive, a receiver, a transmitter, a speaker, a display, a speech synthesizer, an output port, and a user input device (such as a keyboard, a keypad, a mouse, and the like)).

It should be noted that the present invention can be implemented in software and/or in a combination of software and hardware, e.g., using application specific integrated circuits (ASIC), a general purpose computer or any other hardware equivalents. In one embodiment, the present module for asset management in an open environment 605 can be loaded into memory 604 and executed by processor 602 to implement the functions as discussed above. As such, the present method for asset management in an open environment (including RFID reading or sensing and RFID correlation of the present invention can be stored on a computer readable medium or carrier, e.g., RAM memory, magnetic or optical drive or diskette and the like).

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for managing assets in an open environment, comprising:

determining whether an individual is carrying an amount of metal that exceeds a threshold;

generating an alarm signal if the threshold is exceeded;

detecting a radio frequency identification associated with one of the assets at an access point;

determining whether a radio frequency identification associated with an individual who is correlated with the one of the assets is also detected at the access point; and generating a second alarm signal if the radio frequency identification associated with the individual is not detected at the access point.

2. The method of claim 1, wherein the radio frequency identification associated with the one of the assets is implemented by deploying a radio frequency identification tag with the one of the assets.

3. The method of claim 1, wherein the radio frequency identification associated with the individual is implemented by providing a radio frequency identification tag to the individual.

4. The method of claim 3, wherein the radio frequency identification tag is deployed within a key ring.

5. The method of claim 1, wherein the determining whether the radio frequency identification associated with the individual who is correlated with the one of the assets is performed using encrypted communication.

6. The method of claim 1, further comprising:

denying a passage of the one of the assets at the access point if the second alarm signal is generated.

7. The method of claim 1, further comprising:

allowing a passage of the one of the assets at the access point if the radio frequency identification associated with the individual who is correlated with the one of the assets is also detected at the access point.

8. A computer-readable medium having stored thereon a plurality of instructions, the plurality of instructions including instructions which, when executed by a processor, cause the processor to perform a method for managing assets in an open environment, comprising:

determining whether an individual is carrying an amount of metal that exceeds a threshold;

generating an alarm signal if the threshold is exceeded;

detecting a radio frequency identification associated with one of the assets at an access point;

determining whether a radio frequency identification associated with an individual who is correlated with the one of the assets is also detected at the access point; and generating a second alarm signal if the radio frequency identification associated with the individual is not detected at the access point.

9. The computer-readable medium of claim 8, wherein the radio frequency identification associated with the one of the assets is implemented by deploying a radio frequency identification tag with the one of the assets.

10. The computer-readable medium of claim 8, wherein the radio frequency identification associated with the individual is implemented by providing a radio frequency identification tag to the individual.

11. The computer-readable medium of claim 10, wherein the radio frequency identification tag is deployed within a key ring.

12. The computer-readable medium of claim 8, wherein the determining whether the radio frequency identification associated with the individual who is correlated with the one of the assets is performed using encrypted communication.

13. The computer-readable medium of claim 8, further comprising:

denying a passage of the one of the assets at the access point if the second alarm signal is generated.

14. The computer-readable medium of claim 8, further comprising:

allowing a passage of the one of the assets at the access point if the radio frequency identification associated with the individual who is correlated with the one of the assets is also detected at the access point.

15. An apparatus for managing assets in an open environment, comprising:

means for determining whether an individual is carrying an amount of metal that exceeds a threshold;

means for generating an alarm signal if the threshold is exceeded;

means for detecting a radio frequency identification associated with one of the assets at an access point;

means for determining whether a radio frequency identification associated with an individual who is correlated with the one of the assets is also detected at the access point; and means for generating a second alarm signal if the radio frequency identification associated with the individual is not detected at the access point.

16. The apparatus of claim 15, wherein the radio frequency identification associated with the one of the assets is implemented by deploying a radio frequency identification tag with the one of the assets.

17. The apparatus of claim 15, wherein the radio frequency identification associated with the individual is implemented by providing a radio frequency identification tag to the individual.

18. The apparatus of claim 17, wherein the radio frequency identification tag is deployed within a key ring.

19. The method of claim 3, wherein the radio frequency identification tag is deployed within a badge.

20. The computer-readable medium of claim 10, wherein the radio frequency identification tag is deployed within a badge.

* * * * *